US007155893B2

(12) United States Patent
Hatano et al.

(10) Patent No.: US 7,155,893 B2
(45) Date of Patent: Jan. 2, 2007

(54) METHOD OF PRODUCING HEAT-RESISTANT CRIMPED YARN

(75) Inventors: Takeshi Hatano, Tokyo (JP); Kazuhiko Kosuge, Tokyo (JP); Mitsuhiko Tanahashi, Gifu (JP); Iori Nakabayashi, Otsu (JP); Taku Konaka, Nishikasugai-gun (JP); Takahiro Ito, Nishikasugai-gun (JP); Minoru Yamada, Nishikasugai-gun (JP)

(73) Assignees: Du Pont-Toray Co., Ltd., Aichi (JP); Tokai Senko K.K., Aichi (JP)

( * ) Notice: Subject to any disclaimer, the term of this patent is extended or adjusted under 35 U.S.C. 154(b) by 327 days.

(21) Appl. No.: 10/380,526

(22) PCT Filed: Sep. 13, 2001

(86) PCT No.: PCT/JP01/07971

§ 371 (c)(1),
(2), (4) Date: Aug. 6, 2003

(87) PCT Pub. No.: WO02/22930

PCT Pub. Date: Mar. 21, 2002

(65) Prior Publication Data

US 2004/0016221 A1 Jan. 29, 2004

(30) Foreign Application Priority Data

Sep. 14, 2000 (JP) ..... 2000-279922
Nov. 7, 2000 (JP) ..... 2000-33926

(51) Int. Cl.
*D02G 1/00* (2006.01)

(52) U.S. Cl. ..... 57/282; 57/351

(58) Field of Classification Search ..... 57/282, 57/351; 28/284–286
See application file for complete search history.

(56) References Cited

U.S. PATENT DOCUMENTS 4,598,880 A * 7/1986 Brutel et al. ..... 242/164
5,791,135 A * 8/1998 Greenberg ..... 57/290
6,258,927 B1 * 7/2001 Oka et al. ..... 528/310
6,668,535 B1 * 12/2003 Tanahashi et al. ..... 57/289

FOREIGN PATENT DOCUMENTS

| | | |
|---|---|---|
| JP | 52-5350 | 1/1977 |
| JP | 53-78371 | 7/1978 |
| SU | 477204 | 10/1975 |
| SU | 1440973 | 11/1988 |
| SU | 1808031 | 4/1993 |
| SU | 1 793 582 | 11/1996 |

OTHER PUBLICATIONS

Naohisa Ohshima et al., "Structural Studies for Cellulosic Fibers Treated under High Pressure Stream (II)" Preprints of Annual Meeting of Sen-i Gakkai (Kyoto), vol. 55, No. 1, p. 141 (2000).

(Continued)

*Primary Examiner*—Shaun R. Hurley
(74) *Attorney, Agent, or Firm*—Wenderoth, Lind & Ponack, L.L.P.

(57) ABSTRACT

The present invention relates to a method for producing a heat-resistant crimped yarn comprising: twisting yarn of a heat-resistant high functional fiber; twist-setting this twisted yarn by heat treatment; and untwisting this twist-set yarn, wherein a snarl value of the twist-set yarn is not more than 6.5.

8 Claims, 3 Drawing Sheets

OTHER PUBLICATIONS

Mitsuhiko Tanahashi et al., "Transformation of Cellulose Structures by Swelling Solvents and High Pressure Stream Treatments", 7th Annual Meeting of the Cellulose Society of Japan (Tokyo), p. 13-14 (2000).

Naohisa Ohshima et al., "Changes on Structure of Cellulose Microfibrils by High-pressure Steaming", 7th Annual Meeting of the Cellulose Society of Japan (Tokyo), p. 79 (2000).

Naohisa Ohshima et al., "Structural Analysis for Cellulosic Fibers Treated under High Pressure Steam", Proceedings of the 5th Asian Textile Conference (Kyoto), vol. 2, p. 1206-1209 (1999).

Naohisa Ohshima et al., "Structural Studies for Cellulosic Fibers Treated under High Pressure Steam", Preprints of meeting of Sen-i Gakkai (Gifu), F-213 (1998).

Ihoko Shimohata et al., "Fixation Mechanism of Natural Fibers by High-pressure Steam-treatment", Preprints of meeting Sen-i Gakkai (Sakai), F-34 (1997).

Mitsuhiko Tanahashi et al., "Shape-memorization of Cellulosics by High-pressure Steam-treatment", 2nd Meeting of the Cellulose Society of Japan (Uji), p. 39-40 (1995).

Mitsuhiko Tanahashi et al., "Fixation and improvement of cellulosic fiber form by high-pressure steam treatment (II)", 42nd Meeting of the Japan Wood Research Society, p. 371 (1992).

Mitsuhiko Tanahashi et al., "Permanent Set of Natural Fibers and Textiles by High-pressure and High-temperature Steam Treatment", Preprints of meeting of Sen-i Gakkai, F-17 (1992).

* cited by examiner

METHOD OF PRODUCING HEAT-RESISTANT CRIMPED YARN

TECHNICAL FIELD

The present invention relates to a method for producing a heat-resistant crimped yarn comprising heat-resistant high functional fibers such as aramid fibers or the like. More precisely, the invention relates to a method for producing a heat-resistant crimped yarn, which exhibits a good elongation percentage during stretching and a good appearance so as to be able to provide woven or knitted fabric with elasticity and bulkiness. Concretely, the invention relates to a method, which comprises heat-setting twisted yarn of a heat-resistant high functional fiber to produce a heat-set yarn of which a snarl value is not more than 6.5, and untwisting the heat-set yarn.

The present invention also relates to a method useful for producing a heat-resistant crimped yarn on a commercial basis, which is characterized by treatment of twisted yarn with steam having high temperature and high pressure or water having high temperature and high pressure, preferably under decompression, following a specific twisting process of a yarn as mentioned hereinabove.

Moreover, the present invention relates to a bobbin suitable for producing a heat-resistant crimped yarn made of fibers such as aramid fiber or the like on a commercial basis.

BACKGROUND ART

General thermoplastic synthetic fibers such as nylon or polyester fiber melt at about 250° C. However, heat-resistant high functional fibers such as aramid fiber, wholly aromatic polyester fiber and polyparaphenylene-benzobisoxazole fiber do not melt at 250° C., and a decomposition temperature of these fibers is about 500° C. A limited oxygen index of non-heat-resistant general fibers such as nylon or polyester fiber is about 20, and these fibers burn well in air. However, a limited oxygen index of heat-resistant high functional fibers such as those mentioned above is at least about 25, and these fibers may burn in air when they are brought close to a heat source of flame, but could not continue to burn if they are moved away from the flame. To that effect, a heat-resistant high functional fiber has excellent heat resistance and flame retardancy. For example, as a kind of heat-resistant high functional fiber, an aramid fiber is favorable to clothes for use at a high risk of exposure to flame and high temperature, for example, fireman's clothes, racer's clothes, steelworker's clothes, welder's clothes, and the like. Above all, a para-aramid fiber having advantages of heat resistance and high tenacity is much used for sportsman's clothes, working clothes and others that are required to have high tear strength and heat resistance. In addition, as it is hardly cut with edged tools, this fiber is also used for working gloves. On the other hand, a meta-aramid fiber is not only resistant to heat, but also has good weather resistance and chemical resistance, and it is used for fireman's clothes, heat-insulating filters, and electric insulators, and the like.

Heretofore, when a heat-resistant high functional fiber is formed into textile goods such as clothes, it is used merely in a form of non-crimped continuous filament yarn or spun yarn. However, when such non-crimped continuous filament yarn or spun yarn is woven or knitted into fabrics, and from them formed into clothes such as fireman's clothes, racer's clothes and working clothes, these resulting clothes are poorly elastic as the yarn itself is not elastic. As a result, when the clothes are worn, they are unsuitable to exercises and working activities. In particular, working gloves made of a non-crimped continuous filament yarn and a spun yarn are unsuitable to use in industrial fields of airplane and information instrument in which precision parts are handled, as they are unsuitable to exercises and working activities. Using the gloves mentioned hereinabove in those industrial fields often results in a lowering of productivity. Accordingly, an improvement of such a sort of disadvantages of heat-resistant textile goods that exhibit uncomfortable feeling when worn for a working activity is desired.

It is easy to produce a highly crimped filament yarn from general thermoplastic synthetic fibers such as nylon or polyester fiber by using heat-set. For example, known is a false-twisting method for crimping in which a thermoplastic synthetic fiber is twisted, heat-set and cooled. Also known is a stuffing box method for crimping in which a thermoplastic synthetic fiber is forcedly pushed into a rectangular space, and then heat-set.

On the other hand, it is impossible or very difficult to produce a crimped filament yarn of heat-resistant high functional fiber under the same process conditions and procedures as in the false-twisting method or the stuffing box method described above, since this heat-resistant high functional fiber is non-thermoplastic and therefore poorly heat-set. A crimping method which is suitable to a heat-resistant high functional fiber has not been established yet, so a heat-resistant high functional fiber has been used only in a form of non-crimped continuous filament yarn or spun yarn.

However, many studies and proposals have been made, relating to a heat-resistant high functional crimped yarn and to a method for crimping heat-resistant high functional fibers. Concretely, known are a method for producing a heat-resistant crimped fiber from heat-resistant fibers such as wholly aromatic polyamide fiber by selecting spinning conditions, without using a special crimping method and device (Japanese Patent Laid-Open No. 19818/1973), a non-heat stuffing box method in which an optical anisotropic dope such as para-wholly aromatic polyamide or the like is crimped in a stuffing box at room temperature and dried under a state of relaxation after performing a wet spinning method by dry-jet(Japanese Patent Laid-Open No. 114923/1978), a stuffing box method in which a high-elastic fiber such as a para-aramid fiber is crimped, and mixed with a low-elastic fiber (Japanese Patent Laid-Open No. 192839/1989), a method in which an aramid self-crimping filament yarn is produced by wet-and-dry spinning an optical anisotropic dope consisting of aramid and sulfuric acid under specific conditions (Japanese Patent Laid-Open No. 27117/1991), and a continuous process method in which an aramid fiber is false-twisted and crimped by use of a non-contact heater at a temperature not lower than that at which the fiber begins to decompose but lower than a decomposition point of the fibers (for a meta-aramid fiber, the temperature is at least 390° C. but lower than 460° C.), and thereafter subjected to heat treatment under relaxation (Japanese Patent Laid-Open No. 280120/1994). However, all of these known methods could still not solve outstanding technical problems which are how to realize easy process control, simplification of production lines, high productivity, and cost reduction. At present, therefore, no one has succeeded in industrial production of a heat-resistant crimped yarn exhibiting a good elongation percentage during stretching, wherein quality deterioration in a production process is reduced as much as possible.

SUMMARY OF THE INVENTION

In view of the problems in the related art noted above, one object of the present invention is to provide a method for producing a crimped yarn comprising a heat-resistant high functional fiber, which is practical in terms of productivity, equipment therefor and production costs. Another object of the invention is to provide a crimped yarn which is excellent in terms of a stretch modulus of elasticity, heat-resistance, tenacity and appearance, and which is produced while reducing a quality deterioration of a constituent fiber through performance of a heat treatment as much as possible.

Some of the present inventors have provided a method for producing a heat-resistant crimped yarn, which comprises: twisting a heat-resistant high functional fiber such as an aramid fiber or the like; treating this twisted fiber with steam having high temperature and high pressure or with water having high temperature and high pressure (this is hereinafter referred to as treatment with steam having high temperature and high pressure); and thereafter untwisting the twisted fiber (Japanese Application No. 361825/1999).

We, the present inventors have assiduously studied so as to attain the objects as above, and, as a result, have found that, when a snarl value of a heat-set yarn is not more than 6.5 in a method for producing a heat-resistant crimped yarn comprising twisting a heat-resistant high functional fiber, heat-setting this twisted yarn and untwisting this heat-set yarn, twist of a product is sufficiently fixed. And we also have found that an elongation percentage during stretching of the heat-resistant crimped yarn produced by the above method is sufficient to provide a woven or knitted fabric with elasticity, and that ideal clothes which exhibit a good elongation percentage during stretching, an excellent heat resistance, a high tenacity, and a good appearance (for example, fireman's clothes, racer's clothes, steel worker's clothes, and welder's clothes, for example) can be obtained by using this fabric.

The present inventors have further studied so as to improve the above method to produce a heat-resistant crimped yarn on a commercial basis.

Concretely, in producing a heat-resistant crimped yarn on a commercial basis by using the method including treatment with steam having high temperature and high pressure, there is a problem in that heat-setting with steam having high temperature and high pressure is not uniform between a portion of the yarn at a surface of a bobbin and a portion of the yarn away from this surface. That is, in producing a heat-resistant crimped yarn on a commercial basis, it is preferable so as to produce products more efficiently and more cost-effectively that yarn as much as possible be subjected to treatment with steam having high temperature and high pressure at a single time by increasing a thickness of a yarn layer wound around a bobbin. But, in this case, steam having high temperature and high pressure or water having high temperature and high pressure (this is hereinafter referred to simply as steam having high temperature and high pressure) is not provided inside of a yarn cheese or yarn corn, and an interior yarn of the yarn cheese or yarn corn (yarn wound around close to a cylinder of the bobbin) is not heat-set sufficiently. While, when steam having high temperature and high pressure is penetrated into an inner area of the yarn cheese or the yarn corn (this is hereinafter referred to as the inside) sufficiently, and when the inside is heat-set sufficiently by making a treatment time longer, a surface yarn of the yarn cheese or corn (yarn wound around the bobbin far from the cylinder) deteriorates by application of heat.

We have assiduously studied so as to improve the problems as above, and, as a result, have found that uniformity in terms of heat-setting between the surface and the inside by heat-setting with steam having high temperature and high pressure can be improved by reducing pressure in an autoclave before the treatment with steam having high temperature and high pressure. And, we have also found unexpectedly that a necessary time of treatment with steam having high temperature and high pressure can be shortened by using this process. An efficiency of this production process can not only be improved, but also a quality deterioration of yarn through the treatment with steam having high temperature and high pressure can be prevented by using the process.

We have assiduously studied so as to solve the problems on a commercial basis as mentioned above, and, as a result, have found that steam having high temperature and high pressure can be provided inside efficiently and uniformity of heat-setting between the surface and the inside can be improved by providing a plurality of small through holes, of which diameter is about 2 to 9 mm on a surface of a cylinder or/and a flange of a bobbin. Particularly, we have found that the above range of the diameter is preferable for a reason that, in case of too small of through holes, steam having high temperature and high pressure is not provided sufficiently and the through holes may be blocked, and, in case of too large of through holes, marks are found on a heat-resistant crimped yarn.

We have assiduously studied about a hole area rate, and, as a result, have found that the hole area rate is preferably in a range of about 1 to 20%.

Having further studied, we, the present inventors have completed the present invention.

Specifically, the invention relates to the following:

(1) A method for producing a heat-resistant crimped yarn comprising: twisting yarn of a heat-resistant high functional fiber; twist-setting this twisted yarn by heat treatment; and untwisting this twist-set yarn, wherein a snarl value of the twist-set yarn is not more than 6.5;

(2) The method for producing a heat-resistant crimped yarn described in above (1), wherein an elongation percentage during stretching of a heat-resistant crimped yarn is not less than 6%;

(3) The method for producing a heat-resistant crimped yarn described in above (1) or (2), wherein a heat treatment applied to the twisted yarn is performed by bringing the twisted yarn into contact with steam having high temperature and high pressure or water having high temperature and high pressure;

(4) The method for producing a heat-resistant crimped yarn described in above (3), wherein treatment of the twisted yarn with steam having high temperature and high pressure or water having high temperature and high pressure is performed at a temperature falling between 130 and 250° C.;

(5) The method for producing a heat-resistant crimped yarn described in above (3) or (4), which comprises making a yarn cheese or a yarn corn by winding the twisted yarn of a heat-resistant high functional fiber around a bobbin; loading the yarn cheese or yarn corn into an autoclave; reducing pressure in the autoclave; twist-setting the twisted yarn of the yarn cheese or yarn corn by bringing the twisted yarn into contact with steam having high temperature and high pressure or water having high temperature and high pressure; and untwisting this twist-set yarn;

(6) The method for producing a heat-resistant crimped yarn described in above (5), wherein the pressure in the autoclave after reduction is from $5.0\times10^3$ to $5.0\times10^4$ Pa;

(7) The method for producing a heat-resistant crimped yarn described in above (5) or (6), wherein treatment of the twisted yarn with steam having high temperature and high pressure or water having high temperature and high pressure is performed for a period of time falling between 0.5 and 100 minutes;

(8) The method for producing a heat-resistant crimped yarn described in above (5) to (7), wherein a thickness of a yarn layer of the cheese or corn is not less than 15 mm, and a winding density thereof is not less than 0.5 g/cm$^3$;

(9) The method for producing a heat-resistant crimped yarn described in above (1) to (8), wherein a heat-resistant high functional fiber is twisted to a twist parameter K, represented by the following formula, of from 5,000 to 11,000:

$$K=t\times D^{1/2}$$

wherein t indicates a count of twist (turns/m) of the fiber; and D indicates a fineness (tex) of the fiber;

(10) The method for producing a heat-resistant crimped yarn described in above (1) to (9), wherein a heat-resistant high functional fiber is selected from the group consisting of para-aramid fiber, meta-aramid fiber, wholly aromatic polyester fiber and polyparaphenylene-benzobisoxazole fiber;

(11) The method for producing a heat-resistant crimped yarn described in above (10), wherein the para-aramid fiber is a polyparaphenylene-terephthalamide fiber;

(12) A heat-resistant crimped yarn produced by the method described in any one of above (1) to (11); fabric made of the heat-resistant crimped yarn; and clothes made of the fabric;

(13) A method for treating a yarn cheese or a yarn corn, which comprises making the yarn cheese or the yarn corn by winding twisted yarn of a heat-resistant high functional fiber around a bobbin; loading the yarn cheese or the yarn corn into an autoclave; reducing pressure in the autoclave loaded with the yarn cheese or the yarn corn to a pressure falling between $5.0\times10^3$ and $5.0\times10^4$ Pa; and raising temperature in the autoclave to a temperature in the range of from 130 to 250° C. by providing steam having high temperature and high pressure or water having high temperature and high pressure into said autoclave;

(14) A heat-resistant bobbin having a plurality of small through holes on a surface of a cylinder and/or a flange of the bobbin, wherein a diameter of the small through holes is 2 to 9 mm, and a hole area rate thereof is 1 to 20%;

(15) The method for producing a heat-resistant crimped yarn described in above (1) to (11), wherein twist-setting by heat treatment is performed by use of the yarn cheese or the yarn corn made by winding the twisted yarn of a heat-resistant high functional fiber around the heat-resistant bobbin described in above (14);

(16) The method for treating the yarn cheese or the yarn corn described in above (13), wherein the bobbin is heat-resistant as described in above (14);

(17) A device for producing a heat-resistant crimped yarn of a heat-resistant high functional fiber, which comprises: a device for sealing an autoclave; a device for reducing pressure in the autoclave to a pressure falling between $5.0\times10^3$ and $5.0\times10^4$ Pa; a device for supplying steam having high temperature and high pressure or water having high temperature and high pressure into the autoclave; a device for controlling a temperature of the steam having high temperature and high pressure or the water having high temperature and high pressure so as to be maintained in a range of from 130 to 250° C. for a period of time falling between 0.5 and 100 minutes; a device for draining water from the autoclave; and a device for decreasing high pressure in the autoclave to atmospheric pressure.

BRIEF DESCRIPTION OF THE DRAWINGS

In FIG. 1, symbol 1 shows hook A, symbol 2 shows hook C, symbol 3 shows pin B, symbol 4 shows load, symbol 5-*a* shows yarn hanged on hook A, pin B and hook C, symbol 5-*b* shows yarn removed from pin B, and symbol 6 shows divisions.

In FIG. 2, symbol 11 shows the bobbin of the present invention, symbol 12 shows a cylinder, symbol 13 shows a flange and symbol 14 shows small through holes.

DETAILED DESCRIPTION OF THE PREFERRED EMBODIMENTS

Figure 1:
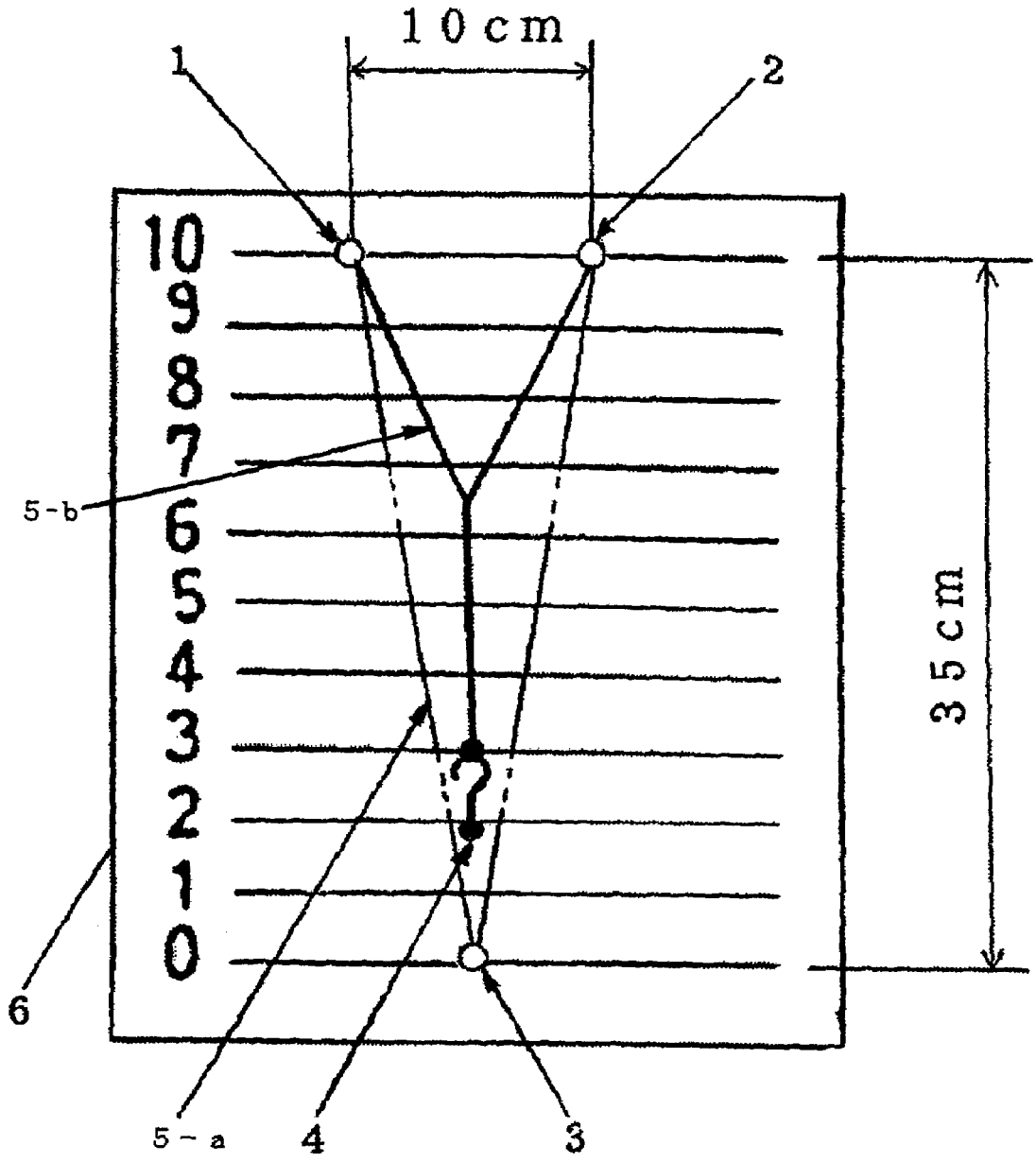
FIG. 1 shows structure of a tester measuring a snarl value of heat-set yarn.
Figure 2:
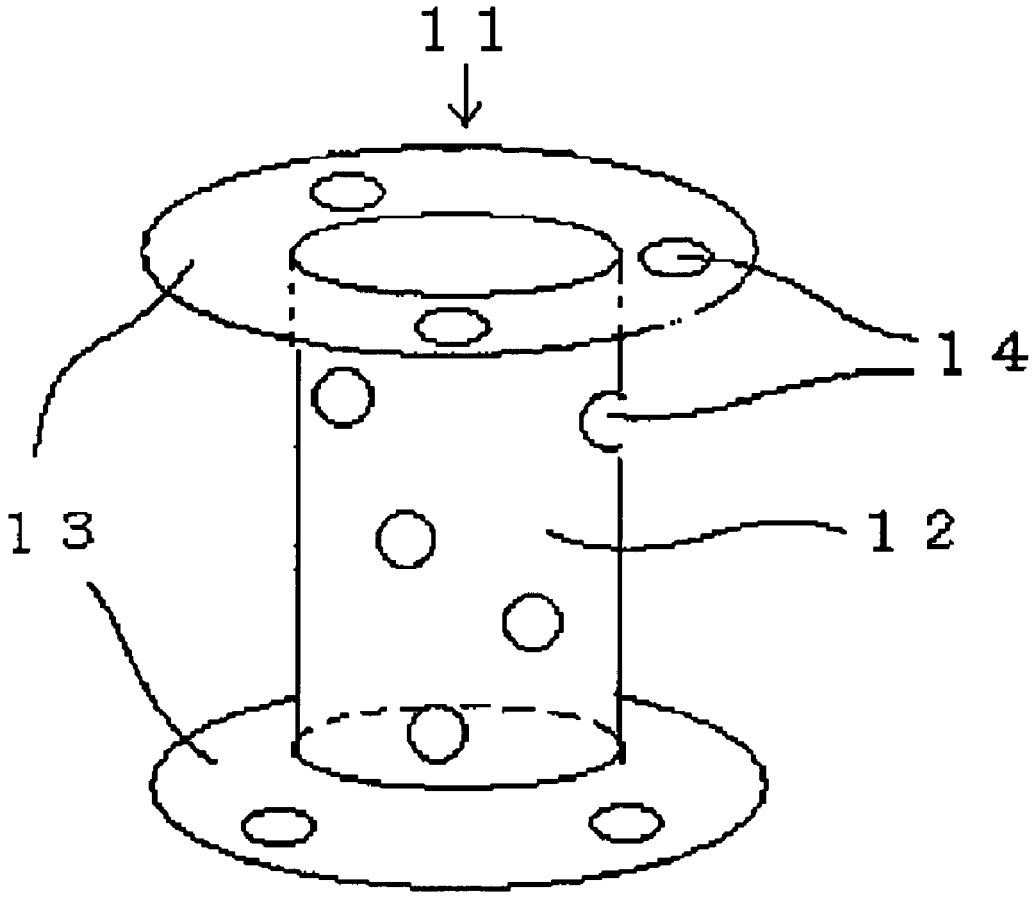
FIG. 2 shows a bobbin of the present invention, which has small through holes.

First: a heat-resistant high functional filament yarn is twisted (this is a primary twisting step in which a yarn is twisted in a direction of S or Z); then this twisted yarn is wound around a heat-resistant bobbin of aluminum or the like; and then this wound twisted yarn is heat-set for twist fixation, preferably under treatment with steam having high temperature and high pressure or water having high temperature and high pressure for predetermined time. Next, this heat-set yarn is untwisted by secondarily twisting it opposite to a primary twisting direction (that is, in the direction of Z or S) to obtain a heat-resistant crimped yarn.

In this method of the present invention, the filaments made of a fiber are deformed to have a spirally complicated shape after the primary twisting step, and this shape is fixed by treatment with heat, preferably, with steam having high temperature and high pressure or with water having high temperature and high pressure. Then, monofilaments untwisted by twisting in an opposite direction are released from a primary twisting force and try to form randomly their own shapes, keeping their own memory of shapes given during the primary twisting step, and as a result, fibers made of monofilaments obtain a form of crimp.

Preferably, a heat-resistant high functional fiber for use in the invention has a limited oxygen index of not less than about 25, and a thermal decomposition point measured in a differential scanning calorimeter of not lower than about 400° C. Examples of the fiber are an aramid fiber, wholly aromatic polyester fiber (e.g., Kuraray's Commercial product named Vectran®), polyparaphenylene-benzobisoxazole fiber (e.g., Toyobo's Commercial product named Zylon®), polybenzimidazole fiber, and the like. The aramid fiber includes a meta-aramid fiber and a para-aramid fiber. Examples of the meta-aramid fiber are meta-wholly aromatic polyamide fiber such as polymetaphenylene-isophthalamide fiber (e.g., DuPont's Commercial product named Nomex®), and the like. Examples of para-aramid fibers are para-wholly aromatic polyamide fibers such as a polyparaphenylene-terephthalamide fiber (e.g., Toray-DuPont's Commercial product named Kevlar®), a copolyparaphenylene-3,4'-diphenylether-terephthalamide fiber (e.g., Teijin's Commercial product named Technora®), and the like.

Even more preferred is a para-aramid fiber, especially a polyparaphenylene-terephthalamide fiber. And more preferred is also a meta-aramid fiber.

In the present method for producing a heat-resistant crimped yarn, the yarn consisting of a heat-resistant high functional fiber is first twisted in a primary twisting step.

The yarn consisting of a heat-resistant high functional fiber may be in any form of either filament yarn or spun yarn. The yarn may be in the form of co-spun yarn or co-twisted yarn with two or more different kinds of the fiber. And, the yarn may be in the form of co-spun yarn or co-twisted yarn with a heat-resistant high functional fiber and other known fibers such as, preferably, a polyester fiber or nylon fiber. In this case, it is preferable that a weight percentage of a heat-resistant high functional fiber is not less than about 50 weight % relative to other fibers.

A filament composing a heat-resistant high functional fiber is preferably made up of a monofilament with a very fine diameter. For example, a yarn, of which total fineness falls between about 22.4 to 44.4 tex, fineness of a monofilament is 0.17tex and a number of monofilaments is 131 to 262, is more preferable.

Monofilament fineness of a heat-resistant high functional fiber used in the invention falls between about 0.02 and 1.0 tex, but preferably between about 0.05 and 0.5 tex. The finer the monofilament, the softer the yarn. Accordingly, a fine monofilament is desirable for clothes, but, on the other hand, in a process of producing a heat-resistant crimped yarn, the finer the monofilament, the more a heat-resistant crimped yarn fluffs and the more difficult its processing. Accordingly, in the present invention, it is preferable that the fineness of a monofilament is not less than 0.02 tex as mentioned above. The thicker the monofilament, the more difficult it is to cut by a knife, and accordingly, a thick monofilament is desirable for use as protective clothes such as working gloves. But, on the other hand, the thicker the monofilament, the stiffer it is, so softness, which is required for final products such as clothes, is reduced by using a thick monofilament. Accordingly, in the present invention, it is preferable that the fineness of a monofilament is not more than 1.0 tex as mentioned above. The total fineness of the yarn used in the invention, which is made of monofilaments, is not specifically defined so long as the fineness of the yarn is sufficient for twisting and untwisting. However, the total fineness of the yarn falls preferably between about 5 and 400 tex, because this yarn is easy to be processed.

In a twisting process, preferably, the yarn is twisted to a twist parameter K, represented by a formula $K=t\times D^{1/2}$ (wherein t indicates a count of twist (turns/m) of the fiber, and D indicates fineness (tex) thereof), of from about 5,000 to 11,000, more preferably from about 6,000 to 9,000. The yarn is desired to be twisted to such a suitable degree defined hereinabove such that the yarn is crimped appropriately sufficient for practical use, and such that filaments of the yarn do not break owing to excessive twisting. The twist parameter, K, is an index indicating a degree of twisting of the fiber irrespective of a thickness of the fiber. The larger the value of the twist parameter, the higher the twist degree.

As a method for twisting yarn, usable is any per-se known method. For example, usable is any per-se known twisting machine such as a ring twister, a double twister, an Italy twister, and the like.

Twisting may be in either direction of Z or S.

The twisted yarn obtained above is wound around a bobbin made of a heat-resistant material such as aluminum or the like. The bobbin referred to herein is usually an ordinary cylindrical winding core around which yarn is wound. Cheese referred to herein is yarn wound up around the bobbin. Especially, in a case that a diameter of each edge of a bobbin is different and a shape of wound yarn is like corn, it is designated as corn or corn cheese. In a case where the twisted yarn is wound around a heat-resistant bobbin, it is unnecessary to rewind the yarn.

Preferably, a bobbin for use herein is made of heat-resistant material, because the bobbin is subjected to a heat treatment. Any per-se known heat-resistant material, including aluminum or the like, is usable herein, preferably a bobbin made from aluminum is usable in the invention.

Also preferably, a bobbin for use herein is worked to have a plurality of small through holes in order that steam having high temperature and high pressure can easily pass through these holes during treatment with steam having high temperature and high pressure. More preferably, the bobbin has a plurality of small through holes uniformly distributed to meet the purpose mentioned above. The bobbin may have a plurality of small through holes either in its entire surface, that is, in a surface of a cylinder and flange, or only in a surface of the cylinder or flange. More preferably, the bobbin has a plurality of small through holes in the surface of cylinder.

A shape of each small through hole is not specifically defined, but is round preferably.

A diameter of each small through hole is preferably about 2 to 9 mm, more preferably about 3 to 5 mm. The diameter is preferably in this range to allow steam having high temperature and high pressure to enter into an interior of the yarn cheese or yarn corn efficiently, as well as to not block a plurality of through holes, and not to leave a mark on this yarn.

Herein, the diameter indicates a length of a longest part of the holes. For example, if the through hole is round, the diameter indicates diameter. If the through hole is a polygon, the diameter indicates a longest diagonal. If the through hole is an ellipse, the diameter indicates a longer axis.

In a plurality of small through holes, a hole area rate is preferably about 1 to 20%, more preferably about 1.5 to 10%. The hole area rate is preferably in this range to efficiently allow steam having high temperature and high pressure to pass into the interior of the yarn cheese or yarn corn.

Herein, the hole area rate indicates a ratio of a total area of a plurality of the small through holes to total surface area of the bobbin. More concretely, the hole area rate is calculated by the following formula.

$$\text{The hole area rate}(\%) = \{\text{the total area of the small through holes}/(\text{the total surface area of the cylinder} + \text{the total surface area of flange} \times 2)\} \times 100$$

A thickness of the yarn cheese or the yarn corn formed by winding the twisted yarn around a bobbin is not less than about 15 mm; and a winding density thereof falls between about 0.4 to 1.0 g/cm$^3$, more preferably between about 0.5 to 0.9 g/cm$^3$, even more preferably between about 0.6 to 0.9 g/cm$^3$. It is preferable that the thickness is not less than about 15 mm to be useful for production on a commercial basis. And it is preferable that the density is in this range from a viewpoint of convenience for handling after treatment; that is, in order to avoid looseness or disorder of the yarn wound on the bobbin.

Next, the yarn corn or yarn cheese is loaded into an autoclave.

The autoclave may have any per-se known structure with steam having high temperature and high pressure being supplied thereinto. One example of the structure of an autoclave for use herein is equipped with a steam duct through which steam having high temperature and high pressure is fed; a water drainage valve; an exhaust valve via which the autoclave is degassed after treatment; an inlet mouth through which the yarn cheese or yarn corn is brought into and removed from the autoclave; and a sealing device to hermetically seal a container equipped with a lid capable of being opened and shut.

Pressure in an autoclave, in which the yarn cheese or yarn corn is loaded, is optionally reduced. Preferably, the pressure after reducing is in a range from about $5.0\times10^3$ to $5.0\times10^4$ Pa, more preferably in a range from about $5.0\times10^3$ to $2.7\times10^4$ Pa. A minimum of the pressure depends on such a factor as the structure of the autoclave, but preferably it is about $5.0\times10^3$ Pa for useful production on a commercial basis.

Air permeated through layers of wound yarn is removed by reducing the pressure mentioned above. As a result, in a next treatment process with steam having high temperature and high pressure, steam having high temperature and high pressure can be quickly permeated into the interior of the yarn cheese or corn, and a uniformity of heat-setting between a surface and the interior of the yarn cheese or corn can be improved. Consequently, one preferred embodiment of the invention is a method including a process of reducing the pressure.

Next, treatment with steam having high temperature and high pressure is peformed. This treatment with steam having high temperature and high pressure may be effected in any per-se known manner. Preferably, steam having high temperature and high pressure is supplied to an autoclave, wherein a yarn cheese or yarn corn is loaded.

A temperature for the treatment with steam having high temperature and high pressure may fall between about 130 and 250° C., preferably between about 130 and 220° C., more preferably between about 140 and 200° C. This temperature range is preferred in order to obtain useful crimped yarn without a deterioration of any property of constituent fibers.

A pressure for the treatment is described. In a case where steam having high temperature and high pressure for the treatment is saturated steam, its pressure shall be physicochemically defined by its temperature. Concretely, pressure of saturated steam at a lowermost temperature of 130° C. is $2.70\times10^5$ Pa, and is $38.97\times10^5$ Pa at an uppermost temperature of 250° C. However, steam for the treatment of the invention is not limited to saturated steam, and its pressure may fall between about $2.7\times10^5$ Pa and $39.0\times10^5$ Pa. Needless-to-say, steam pressure could not be more than saturated steam pressure at the same temperature.

Especially preferably, treatment with steam having high temperature and high pressure is effected at a temperature falling between about 130° C. and 250° C., preferably between about 130 and 220° C., more preferably between about 140 and 200° C.; and under a pressure falling between about $2.7\times10^5$ Pa and $39.0\times10^5$ Pa, preferably between about $2.7\times10^5$ Pa and $23.2\times10^5$ Pa, more preferably between about $3.5\times10^5$ Pa and $23.2\times10^5$ Pa.

In place of steam having such high temperature and high pressure, water having such high temperature and high pressure can also be used herein. In this case, a water temperature may fall between about 130 and 250° C. (but preferably between about 130 and 220° C., more preferably between about 140 and 220° C.); and water pressure may fall between about $2.70\times10^5$ Pa and $39.0\times10^5$ Pa (preferably between about $2.7\times10^5$ Pa and $23.2\times10^5$ Pa, more preferably between about $3.5\times10^5$ Pa and $23.2\times10^5$ Pa). For treatment with water having high temperature and high pressure, expressions "steam having high temperature and high pressure" and "steam" given hereinabove and hereinunder shall be replaced by "water having high temperature and high pressure" and "water", respectively.

A time for treatment with steam having high temperature and high pressure is not indiscriminately defined, as depending on an amount of fibers of the yarn cheese or yarn corn. It is enough that a predetermined temperature is maintained for a few minutes. Preferably, the time for the treatment falls between about 2 and 100 minutes, more preferably between about 3 and 60 minutes. In a case of production on a commercial basis, especially in a case that a process under reduced pressure mentioned above is performed, the time for treatment falls between about 0.5 and 100 minutes, more preferably between about 0.5 and 60 minutes, even more preferably between about 0.5 and 30 minutes. This defined range of the time for the treatment is preferred for more uniform heat-set between a surface and the interior of fibers wound around a bobbin without any substantial deterioration of a constituent fiber.

The present invention is characterized in that a snarl value of a heat-resistant high functional twisted yarn after a heat-setting treatment (twist set by heat treatment) is not more than 6.5. A preferable range of the snarl value is about 6.5 to 0. A more preferable range thereof is about 6 to 0, and a most preferable range thereof is about 5 to 0. This defined range of the snarl value is preferred for a satisfactory twist set by heat treatment and to obtain a practical crimped yarn.

The snarl value is measured by an instrument illustrated in FIG. 1. Twisted yarn, that is, a sample subjected to a twist set by a heat treatment is hanged on hook A, pin B and hook C under a suitable load (about $(0.98 \text{ to } 2.94)\times10^{-2}$N) {1 to 3 gf}, and then the sample is fixed by hook A and hook C. And a head of the load is put on a part where the sample is contacted with pin B. And then, the sample is removed from the pin B, and snarl stops at a position. This position is measured on divisions of the instrument. A figure measured on the divisions is defined as an index of snarl value. This measurement is repeated thirty times, and a mean of these thirty measured values is defined as the snarl value (significant figure is a decimal first place). That is, the snarl value is measured according to JIS L 1095(1999) 9.17.2 B that shows a testing method for general spun yarn.

We explain a treatment with steam having high temperature and high pressure mentioned above more concretely by using FIG. 3. But an embodiment mentioned below is one of embodiments of the present invention, so the present invention is not limited to this embodiment.

Figure 3:
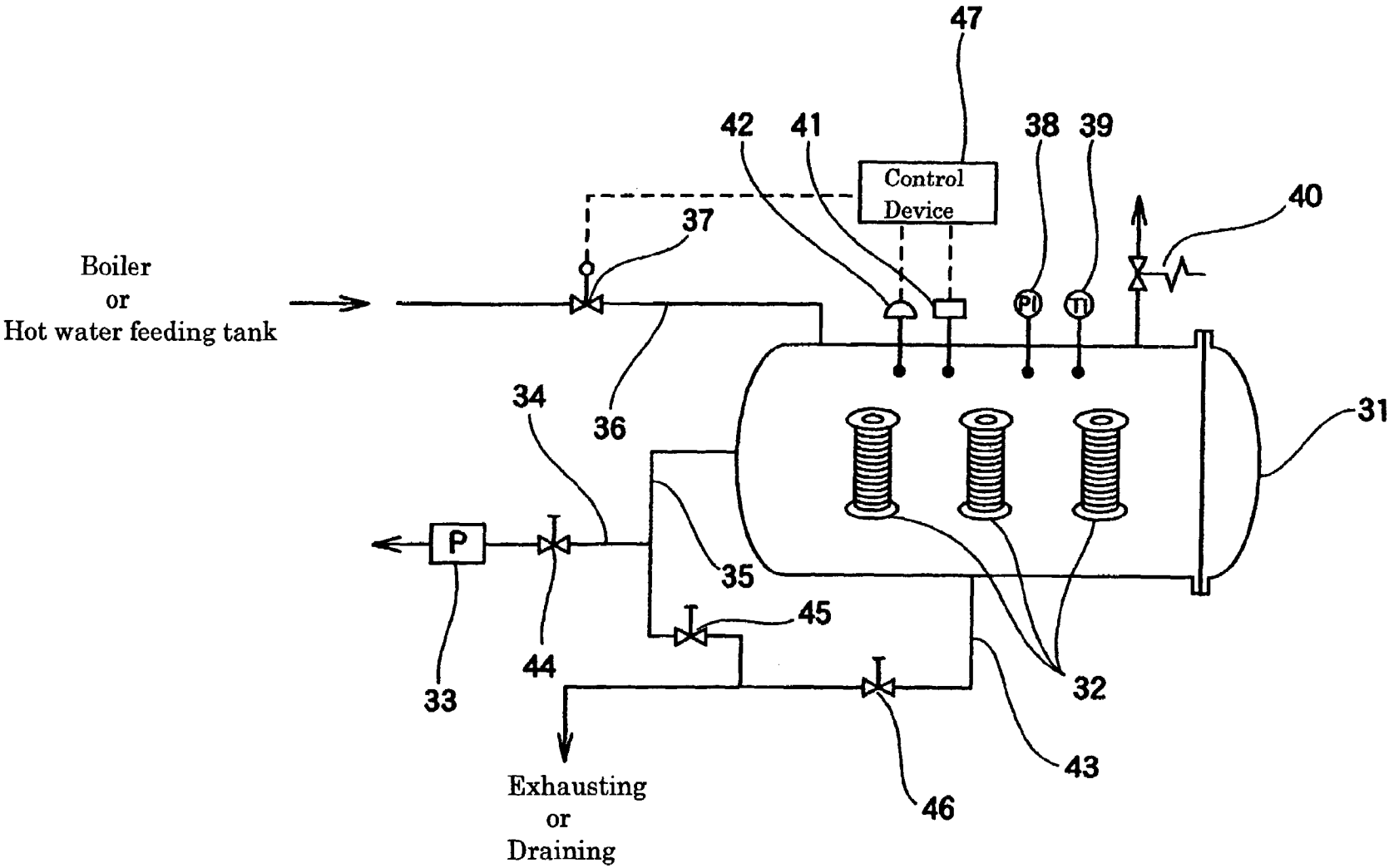
FIG. 3 shows an outline of an autoclave for treatment with steam having high temperature and high pressure.

A device of the present invention shown in FIG. 3 contains autoclave 31, which can be sealed, and in which cheese yarn 32 of a heat-resistant high functional fiber primarily twisted can be loaded. In FIG. 3, symbol 33 is a vacuum pump, which through a pipe 34 for reducing pressure, through exhausting pipe 35 and through the vacuum pump 33, is connected with the autoclave 31. Symbol 36 is a pipe for providing steam having high temperature and high pressure or water having high temperature and high pressure, which through operation valve 37 is connected with the autoclave 31.

And, in the device of the present invention, the autoclave 31 is equipped with a pressure gage 38, a thermometer 39, a safety valve 40, a pressure sensor 41 and a temperature sensor 42.

Moreover, a draining pipe 43 for draining water from the autoclave 31 after treatment with steam having high temperature and high pressure, and the exhausting pipe 35 for returning the pressure in the autoclave to atmospheric pressure are connected with the autoclave 31 mentioned above. The pipe for reducing pressure 34, the exhausting pipe 35 and the draining pipe 43 are equipped with manual operation valves 44, 45, and 46, respectively.

For example, treatment with steam having high temperature and high pressure can be performed by using the above device as follows. First, the yarn cheese 32 is loaded into the autoclave 31, the manual operation valve 44 of the pipe for reducing pressure 34 is opened, and the manual operation valve 45 of the exhausting pipe 35 and the manual operation valve 46 of the draining pipe 43 are closed after the vacuum pump 33 begins to work. As a result, air in the autoclave 31 is exhausted, and pressure in the autoclave 31 is reduced to a pressure from $5.0\times10^3$ Pa to $5.0\times10^4$ Pa.

Next, the manual operation valve 44 of the pipe for reducing pressure 34 is closed, and the automatic operation valve 37 of the providing pipe 36 is opened. And then, steam having high temperature and high pressure is supplied into the autoclave 31. Pressure and temperature are measured by the pressure sensor 41 and temperature sensor 42, respectively, to maintain a temperature of the steam supplied into the autoclave 31 in a range of about 130 to 250° C. for about 0.5 to 100 minutes. A control device 47 controls opening and closing of the automatic operation valve 37 of the providing pipe 36 on a basis of the above measured values.

Herein, the above control may be peformed either on a basis of pressure or on a basis of temperature. But, preferably the above control is performed on the basis of pressure because precision of control on the basis of pressure is better than on the basis of temperature. And, the manual operation valves 44, 45, and 46 can be opened and closed not only manually, but also these valves can be opened and closed automatically under control of a program, by modification to automatic operation valves.

After treatment with steam having high temperature and high pressure, the automatic operation valve 37 of the providing pipe 36 and the manual operation valve 44 of the pipe 34 for reducing pressure are closed, and then the autoclave is exhausted through the exhausting pipe 35, and is drained through the draining pipe 43. After returning the pressure in the autoclave to atmospheric pressure in that way, the yarn cheese or the yarn corn are removed from the autoclave 31.

After being treated with steam having high temperature and high pressure, the twisted yarn is untwisted by again twisting it in the direction opposite to the primary twisting. For this untwisting step, used is any per-se known twisting machine, as in the primary twisting step. At this time, yarn is so untwisted that preferably a count of twist of the yarn is almost zero. Concretely, although the count of twist after being untwisted is not indiscriminately defined, as depending on fineness of yarn, the count of twist is preferably about 0±100 (t/m), more preferably about 0±50 (t/m). Especially, it is more preferable that yarn is untwisted as far it was twisted in the opposite direction over zero. Concretely, it is more preferable that the count of twist of untwisted yarn is about 0 to (−50)(t/m).

In this way, heat-resistant crimped yarn of the invention can be produced. An elongation percentage during stretching of the heat-resistant crimped yarn produced by the present method is not less than about 6%, preferably about 10 to 50%. A stretch modulus of elasticity of the heat-resistant crimped yarn is not less than about 40%, preferably about 50 to 100%.

The heat-resistant crimped yarn of the present invention has excellent heat-resistance and elasticity, so that it has a wide range of application. For example, a fabric with heat-resistance and elasticity can be produced by weaving or knitting the heat-resistant crimped yarn by a per-se known method. Functional clothes with elasticity and exhibiting a good feeling when worn, which can be used for various applications which need heat-resistance and elasticity, can be produced by using this fabric. Examples of these clothes are thin safety gloves with heat-resistance, fireman's clothes, racer's clothes, steel worker's clothes and welder's clothes, for example.

EXAMPLE

The invention is described concretely with reference to the following Examples.

Physical properties of samples prepared are measured and evaluated according to methods mentioned below.

Limited Oxygen Index:

Measured according to JIS K7201 (1999) that indicates a combustion test for polymer materials based on a limited oxygen index.

Thermal Decomposition Point:

Measured according to JIS K7120 (1987) that indicates a method for measuring a thermal weight loss of plastics.

Elasticity:

Measured according to JIS L1013 (1999) that indicates a method for testing filament yarn of chemical fibers. According to Test Method, Article 8.11.A, an elongation percentage during stretching of each sample is determined. Preparation before a measurement is described below. A skein of the sample is wrapped up in a gauze, and subjected to treatment with warm water at 90° C., for 20 minutes, and is allowed to air-dry at room temperature.

Percentage of Elastic Recovery:

Measured according to JIS L1013 (1999) that indicates a method for testing filament yarn of chemical fibers. According to Test Method, Article 8.12, a percentage of elastic recovery of each sample is determined. Preparation before this measurement is described below. A skein of the sample is wrapped in a gauze, and subjected to treatment with warm water at 90° C., for 20 minutes, and is allowed to air-dry at room temperature.

Fineness:

Measured according to JIS L1013 (1999) that indicates a method for testing a filament yarn of chemical fibers. According to Test Method, Article 8.3, fineness based on a corrected weight of each sample is determined.

Tensile Strength:

Measured according to JIS L1013 (1999) that indicates a method for testing filament yarn of chemical fibers. According to Test Method, Article 8.5.1, tensile strength of each sample is determined. In order to prevent monofilaments in each sample from being disordered and to give a uniform tension to all constituent monofilaments, the sample is twisted to a twist parameter, K of 1000, before being tested.

Snarl Value:

Measured according to JIS L1095 (1999) that indicates a method for testing ordinary spun yarn. According to Test Method, Article 9.17.2.B, a snarl value of each sample is determined.

Examples 1 to 4, and Comparative Examples 1, 2

Used was polyparaphenylene-terephthalamide filament yarn (Toray-DuPont's Commercial product named Kevlar®) having a limited oxygen index of 29, a thermal decomposition point of 537° C., a tensile strength of 2.03N/tex, and a tensile modulus of 49.9N/tex. This is composed of 131 monofilaments with a fineness of 0.17 tex per filament whose total fineness is 22.2 tex. The yarn was first twisted to a twist parameter K of 1937 to 9909 by double twister. And a snarl value of this obtained twisted yarn was measured. Next, 200 g of the twisted yarn was wound around an aluminum bobbin, and a yarn cheese was formed. And then the yarn cheese was subjected to heat-set with saturated steam at 200° C. for 15 minutes. And a snarl value of this obtained heat-set yarn was measured. Next, using the same double twister, the yarn was again twisted in the direction opposite to a primary twisting direction to a count of twist zero, whereby a heat-resistant crimped yarn of the invention was obtained. Physical properties of the crimped yarn were measured. Results are shown in Table 1.

Example 5

Used was polyparaphenylene-terephthalamide filament yarn (Toray-DuPont's Commercial product) of which fineness is 44.4 tex. The yarn was twisted, heat-set with saturated steam or through dry heat treatment, and untwisted in the same manner as in Example 1, except that the twist parameter during a primary twisting step was 7536. Physical properties of this heat-resistant crimped yarn were measured. Results are shown in Table 1.

Comparative Example 3

The same yarn as in Example 1 was twisted, heat-set with saturated steam or through dry heat treatment, and untwisted in the same manner as in Example 3, except that heat-setting was performed at low temperature; that is, this twisted yarn was heat-set with saturated steam at 120° C. for 15 minutes. Physical properties of this heat-resistant crimped yarn were measured. Results are shown in Table 1.

TABLE 1

| | Fineness (tex) | Count of Twists (turns/m) | Twist Parameter (K) | Temperature of heat-setting (° C.) | Snarl value before heat-setting | Snarl value after heat-setting | Elongation Percentage in Stretch (%) |
|---|---|---|---|---|---|---|---|
| Example 1 | 22.2 | 1080 | 5087 | 200 | 9.5 | 4 | 7 |
| Example 2 | 22.2 | 1338 | 6304 | 200 | 9.5 | 5 | 17.6 |
| Example 3 | 22.2 | 1753 | 8260 | 200 | 9.5 | 5.5 | 28 |
| Example 4 | 22.2 | 2103 | 9909 | 200 | 9.6 | 6 | 31.6 |
| Example 5 | 44.4 | 1131 | 7536 | 200 | 9.4 | 5.2 | 29.6 |
| Comp. Ex. 1 | 22.2 | 411 | 1937 | 200 | 8 | 2 | 3.5 |
| Comp. Ex. 2 | 22.2 | 549 | 2587 | 200 | 9 | 3 | 4 |
| Comp. Ex. 3 | 22.2 | 1753 | 8260 | 120 | 9.5 | 8.5 | 4.9 |

The twist parameter in Examples 1 to 4 was a high level, and a snarl value of the yarn before twist-setting was less than 9.5. The twisted yarn was twist-set by heat treatment with saturated steam. As a result, a snarl value of the yarn after twist-setting was 4 to 6, and it showed twist was fixed. So, an elongation percentage during stretching of a heat-resistant crimped yarn obtained by untwisting the twist-set yarn was 7 to 31.6%. This level of an elongation percentage during stretching was satisfactory to raw material for stretchable and excellent woven and knitted fabric. And an amount of a yarn wound around a bobbin was small, so lack of uniformity of heat-setting between a surface and an interior of the yarn cheese was not observed.

And, in Example 5, a snarl value of the yarn after twist-setting was 4 to 6, and twist was sufficiently fixed. So, an elongation percentage during stretching of a heat-resistant crimped yarn obtained was 29.6%. The said heat-resistant crimped yarn was satisfactory to raw material for stretchable and excellent fabric. And an amount of the yarn wound around a bobbin was small, so lack of uniformity of heat-setting between a surface and an interior of the yarn cheese was not observed.

On the other hand, in Comparative Examples 1 and 2, a snarl value of the yarn after twist-setting is low, that is 2 and 3, and twist was fixed. But a twist parameter of primary twisting was low, so an elongation percentage during stretching of a heat-resistant crimped yarn obtained was low, that is 3.5 and 4%. As a result, a stretchable and excellent fabric could not be obtained.

In the Comparative Example 3, a snarl value of the yarn after twist-setting was 8.5, and twist was not sufficiently fixed. An elongation percentage during stretching of a heat-resistant crimped yarn obtained was 4.9, so the heat-resistant crimped yarn was not satisfactory for raw material for stretchable and excellent fabric.

Example 6

Used was polyparaphenylene-terephthalamide filament yarn (Toray-DuPont's Commercial product named Kevlar®) having a limited oxygen index of 28, a thermal decomposition point of 537° C., a tensile strength of 2.03N/tex, and a tensile modulus of 49.9N/tex. And its fineness was 22.2 tex. The yarn was first twisted to a twist parameter K of 7539 by a double twister. And 1 kg of this twisted yarn was wound around an aluminum bobbin, around which 1 kg yarn could be wound, and a yarn cheese was formed. In the yarn cheese, an internal diameter of a bobbin cylinder was 84 mm, an external diameter of a bobbin cylinder was 90 mm, a width of the yarn cheese was 164 mm, a thickness thereof was 25 mm and a winding density thereof was 0.7 g/cm$^3$.

The above bobbin was loaded into an autoclave, and pressure in the autoclave was reduced to $2.7\times10^4$ Pa for three minutes. Later, saturated steam at 180° C. was provided in the autoclave for 10 minutes. The autoclave was left as it was for 30 minutes, steam in the autoclave was exhausted, the pressure in the autoclave returned to atmospheric pressure, and the yarn cheese was removed.

Next, using the same double twister, the yarn was again twisted in a direction opposite to a primary twist direction to a count of twist zero, whereby a heat-resistant crimped yarn of the invention was obtained.

A sample for testing was taken from a most-outer part, a central part and a most-inner part of the yarn cheese at heat-setting. Physical properties of this heat-resistant crimped yarn were measured. Results are shown in Table 2. A snarl value was measured after heat-set and before untwisting, and other physical properties were measured after untwisting.

Comparative Example 4

A heat-resistant crimped yarn was produced in the same manner as in Example 6, except pressure was not reduced before treatment with steam having high temperature and high pressure in an autoclave. A sample for testing was taken from a most-outer part, a central part and a most-inner part of a yarn cheese at heat-setting. Physical properties of this heat-resistant crimped yarn were measured. Results are shown in Table 2.

Example 7

A heat-resistant crimped yarn of the present invention was produced in the same manner as in Example 6, except that 3 kg of twisted yarn was wound around an aluminum bobbin, around which 3 kg yarn can be wound. In a yarn cheese, an internal diameter of a bobbin cylinder was 64 mm, an external diameter of a bobbin cylinder was 70 mm, a width of the yarn cheese was 170 mm, a thickness thereof was 60 mm and a winding density thereof was 0.7 g/cm$^3$.

A sample for testing was taken from a most-outer part, a central part and a most-inner part of the yarn cheese at heat-setting. Physical properties of this heat-resistant crimped yarn were measured. Results are shown in Table 2.

Example 8

A heat-resistant crimped yarn of the present invention was produced in the same manner as in Example 6, except that saturated steam at 200° C. was provided in an autoclave for 10 minutes, and the autoclave was left as it was for 15 minutes, A sample for testing was taken from a most-outer part, a central part and a most-inner part of a yarn cheese at heat-setting. Physical properties of this crimped yarn were measured. Results are shown in Table 2.

TABLE 2

| | Part | Snarl Value | Tenacity (N/tex) | Elongation Percentage in Stretch (%) |
|---|---|---|---|---|
| Example 6 | Most-outer | 4.9 | 1.39 | 29.4 |
| | Central | 5.0 | 1.37 | 29.1 |
| | Most-inner | 4.7 | 1.37 | 28.9 |
| Comparative Example 4 | Most-outer | 4.9 | 1.38 | 29.7 |
| | Central | 6.9 | 1.42 | 20.2 |
| | Most-inner | 8.1 | 1.46 | 4.8 |
| Example 7 | Most-outer | 4.8 | 1.38 | 29.8 |
| | Central | 4.6 | 1.37 | 30.1 |
| | Most-inner | 4.9 | 1.38 | 29.6 |

TABLE 2-continued

| | Part | Snarl Value | Tenacity (N/tex) | Elongation Percentage in Stretch (%) |
|---|---|---|---|---|
| Example 8 | Most-outer | 4.3 | 1.35 | 30.5 |
| | Central | 4.7 | 1.36 | 31.5 |
| | Most-inner | 4.5 | 1.34 | 31.0 |

As it is shown in Table 2, in Examples 6 to 8, there is no difference in the physical properties of a heat-resistant crimped yarn of the invention between the most-outer part and the most-inner part of the yarn cheese. On the other hand, in Comparative Example 4, an elongation percentage during stretching in the most-inner part is lower than that in the most-outer part of the yarn cheese, and there was lack of uniformity of heat-setting between the surface and the interior of the yarn cheese. An elongation percentage during stretching is most important for a heat-resistant crimped yarn.

Example 9

Small round through holes, of which diameter is 4 mm, were made uniformly on a surface of a heat-resistant bobbin made of aluminum, wherein an internal diameter of a bobbin cylinder was 84 mm, an external diameter of the bobbin cylinder was 90 mm, and a width of yarn cheese was 164 mm. A number of the through holes was 96, and concretely was 8 in a vertical direction and was 12 in a circumferential direction. In this case, a hole area rate was 2.7%.

Used was polyparaphenylene-terephthalamide filament yarn (Toray-DuPont's Commercial product named Kevlar®) having a limited oxygen index of 28, a thermal decomposition point of 537° C., a tensile strength of 2.03N/tex, and a tensile modulus of 49.9N/tex. And its fineness was 22.2 tex. The yarn was first twisted to a twist parameter K of 7539 by a double twister. And this twisted yarn was wound around the bobbin described above, and a yarn cheese was formed. A width of the yarn cheese was 25 mm and a winding density thereof was 0.7 g/cm$^3$.

The above yarn cheese was loaded into an autoclave. Heat treatment with saturated steam at 180° C. was performed for 30 minutes.

Next, using the same double twister, the yarn was again twisted in a direction opposite to a primary twisting direction to a count of twist zero, whereby a heat-resistant crimped yarn of the invention was obtained.

Comparative Example 5

A heat-resistant crimped yarn was produced in the same manner as in Example 9, except that the number of the through holes is different, and the hole area rate is small, that is 0.97%. The number of the through holes was 32, and concretely was 8 in a vertical direction of a bobbin and was 4 in a circumferential direction of the bobbin. In this case, the through holes are small and round, of which diameter is 4 mm.

A sample for testing was taken from a most-outer part, a central part and a most-inner part of a yarn cheese at heat-setting. Physical properties of this crimped yarn were measured.

Comparative Example 6

A heat-resistant crimped yarn was produced in the same manner as in Example 9, except that the number and size of the through holes are different. The number thereof was 40, and concretely was 8 in a vertical direction of a bobbin and was 5 in a circumferential direction of the bobbin. And the size of the through holes was big, that is, a diameter thereof was 10 mm.

Comparative Example 7

A heat-resistant crimped yarn was produced in the same manner as in Example 9, except that the number and size of the through holes are different. The number thereof was 1482, and concretely was 26 in a vertical direction of a bobbin and was 57 in a circumferential direction of the bobbin. And the size of the through holes was small, that is, a diameter thereof was 1 mm.

Results are shown in Table 3. A snarl value was measured after heat-setting with steam having high temperature and high pressure and before untwisting, and an elongation percentage during stretching and a percentage of elastic recovery were measured after untwisting.

TABLE 3

| | | Example 9 | Comparative Example 5 | Comparative Example 6 | Comparative Example 7 |
|---|---|---|---|---|---|
| Diameter of the through hole (mm) | | 4 | 4 | 10 | 1 |
| Number of the through hole (that in the vertical direction × that in the circumference direction) | | 96 (8 × 12) | 32 (8 × 4) | 40 (8 × 5) | 1482 (26 × 57) |
| Hole area rate (%) | | 2.67 | 0.97 | 5.38 | 2.00 |
| Snarl value | Most-outer part | 4.8 | 4.8 | 4.7 | 4.8 |
| | Central part | 4.6 | 6.8 | 4.8 | 4.7 |
| | Most-inner part | 4.7 | 7.2 | 4.9 | 4.7 |
| Elongation percentage in stretch (%) | Most-outer part | 30.0 | 30.5 | | |
| | Central part | 29.5 | 18.3 | | |
| | Most-inner part | 29.6 | 4.5 | | |
| Percentage of elastic recovery (%) | Most-outer part | 7.4 | 7.4 | | |
| | Central part | 7.3 | 4.5 | | |
| | Most-inner part | 7.4 | 0.5 | | |

From data of Example 9 and Comparative Example 6, the hole area rate is preferably not less than 1% in order to perform a satisfactory heat-set of the yarn cheese. In Example 9, the hole area rate of the bobbin cylinder was 2.67%, and steam was infiltrated into a most-inner part of the yarn cheese. So, all twists, from a most-outer part to the most-inner part of the yarn cheese, were fixed uniformly as a snarl value showed. As a result, an elongation percentage during stretching and a recovery percentage of elasticity of a heat-resistant crimped yarn obtained by untwisting were uniform all over the yarn cheese, from the most-outer part to the most-inner part. Herein, an elongation percentage during stretching is indicative of elasticity, and a recovery percentage of elasticity is indicative of contractibility. On the other hand, in Comparative Example 5, the hole area rate of the cylinder of the bobbin was 0.97%, and steam did not infiltrate into a most-inner part of the yarn cheese efficiently. So a snarl value of the yarn in the most-inner part is high, and in heat-resistant crimped yarn obtained by untwisting, an elongation percentage during stretching and a recovery percentage of elasticity of the yarn in the most-inner part were quite worse than in the most-outer part of the yarn cheese.

And in Comparative Example 5, marks of the through holes were made on a heat-resistant crimped yarn. Thus, the diameter of the through holes is preferably less than 9 mm so as not to make marks on a heat-resistant crimped yarn.

In Comparative Example 5, the through holes were blocked with fiber deposit (waste fiber). That is, during a twisting process, filaments of the yarn touch a yarn guide and are worn down. As a result, fibril (fine nap) is released, and that released fibril gets deposited, (waste fiber). A kind of surfactant, which prevents fibers from generation of static electricity, and those fibers deposited adhere to inside of the through holes, therefore, the through holes were clogged. Accordingly, the diameter of the through holes is preferably more than about 2 mm to perform treatment with steam having high temperature and high pressure without clogging up the through holes.

INDUSTRIAL APPLICABILITY

This invention is characterized by a method for producing a heat-resistant crimped yarn comprising: primary twisting yarn of a heat-resistant high functional fiber; twist-setting this twisted yarn by heat treatment; and untwisting this twist-set yarn, wherein a snarl value of the twist-set yarn is not more than 6.5. In this production method, for example, the yarn can be sufficiently crimped by use of any ordinary autoclave or the like, in which the twisted yarn to be heat-set may be kept at a predetermined temperature only for a short period of time. Therefore, the production method has such advantages as an availability of ordinary equipment, easy process control, lower costs and high productivity. By using the production method, obtained is a heat-resistant crimped yarn, with a good stretch modulus of elasticity, heat-resistance, strength and a good appearance. Since the heat-setting treatment in the method is effected at a temperature lower than a decomposition point of a heat-resistant high functional fiber, the yarn is prevented from being deteriorated under heat. Accordingly, an excellent and practical heat-resistant crimped yarn, which has a good stretch modulus of elasticity and heat-resistance, can be obtained. And then, by using this heat-resistant crimped yarn, a fabric, which has a good elasticity and heat-resistance, can be produced. And then, by using this fabric, functional clothes, which have good elasticity and exhibit a comfortable feeling when worn, can be produced.

And, in the method for producing a heat-resistant crimped yarn of the present invention, uniformity of heat-setting between a surface and an interior of a yarn cheese by steam having high temperature and high pressure can be improved by reducing pressure in the autoclave or using a heat-resistant bobbin which has small through holes. Therefore, by using the present method, a heat-resistant crimped yarn mentioned above can be produced efficiently and on a commercial basis. A time of treatment with steam having high temperature and high pressure is reduced by the improvement mentioned above. Accordingly, the yarn is prevented from being deteriorated under heat, therefore, a heat-resistant crimped yarn, which has a good stretch modulus of elasticity and heat-resistance, can be obtained. Moreover, a large amount of yarn can be crimped at a time, so production costs can be reduced, and productivity can be high.

What is claimed is:

1. A method for producing a heat-resistant crimped yarn, comprising:

providing twisted yarn by twisting yarn of a heat-resistant high functional fiber such that said heat-resistant high functional fiber is twisted to a twist parameter K of from 5,000 to 11,000, wherein K is represented by the formula $$K=t\times D^{1/2}$$

with t indicating a count of twist of the fiber in terms of turns/m, and D indicating a fineness of the fiber in terms of tex;

making yarn cheese or yarn corn having a thickness of at least 15 mm and having a winding density of at least 0.5 g/cm$^3$ by winding said twisted yarn around a heat-resistant bobbin having through holes in a surface of a cylinder and/or a flange of said bobbin, with a diameter of each of said through holes being from 2 mm to 9 mm, and with a hole area rate defined by said through holes being 1% to 20%;

loading said yarn cheese or yarn corn into an autoclave;

reducing pressure in said autoclave so as to be within a range of from $5.0\times10^3$ Pa to $5.0\times10^4$ Pa;

bringing said yarn cheese or yarn corn, while in said autoclave, into contact with steam having a high pressure and a high temperature within a range of from 130° C. to 250° C. or water having a high pressure and a high temperature within a range of from 130° C. to 250° C., thereby providing twist-set yarn having a snarl value of at most 6.5; and untwisting said twist-set yarn.

2. The method according to claim 1, wherein twisting yarn of a heat-resistant high functional fiber comprises twisting yarn of a heat-resistant high functional fiber exhibiting an elongation percentage of at least 6% during stretching thereof.

3. The method according to claims 2, wherein bringing said yarn cheese or yarn corn into contact with the steam having the high pressure and the temperature within the range of from 130° C. to 250° C. or the water having the high pressure and the temperature within the range of from 130° C. to 250° C. comprises bringing said yarn cheese or yarn corn into such contact for a period of time ranging from 0.5 minutes to 100 minutes.

4. The method according to claim 2, wherein twisting yarn of a heat-resistant high functional fiber comprises twisting yarn of a heat-resistant high functional fiber selected from the group consisting of a para-aramid fiber, a meta-aramid fiber, a wholly aromatic polyester fiber and a polyparaphenylene-benzobisoxazole fiber.

5. The method according to claim 4, wherein the para-aramid fiber is polyparaphenylene-terephthalamide fiber.

6. A heat-resistant crimped yarn produced by the method of claim 2.

7. A fabric made from heat-resistant crimped yarn produced by the method of claim 2.

8. An article of clothing made from fabric made from heat-resistant crimped yarn produced by the method of claim 2.

* * * * *

UNITED STATES PATENT AND TRADEMARK OFFICE

CERTIFICATE OF CORRECTION

PATENT NO. : 7,155,893 B2
APPLICATION NO. : 10/380526
DATED : January 2, 2007
INVENTOR(S) : Takeshi Hatano et al.

It is certified that error appears in the above-identified patent and that said Letters Patent is hereby corrected as shown below:

TITLE PAGE,

Item (73), line 1, "Aichi (JP)" should read --Tokyo (JP)--.

Signed and Sealed this

Nineteenth Day of February, 2008

JON W. DUDAS
*Director of the United States Patent and Trademark Office*